US011812783B2

(12) United States Patent
Zaniboni

(10) Patent No.: US 11,812,783 B2
(45) Date of Patent: Nov. 14, 2023

(54) APPARATUS AND METHOD TO AUTOMATICALLY INSERT A LIQUID IN COMPONENTS FOR INHALERS; IN PARTICULAR CARTOMIZERS FOR ELECTRONIC CIGARETTES

(71) Applicant: I.M.A. Industria Macchine Automatiche S.p.A., Ozzano dell'Emilia (IT)

(72) Inventor: Carlo Zaniboni, Ozzano dell'Emilia (IT)

(73) Assignee: I.M.A. INDUSTRIA MACCHINE AUTOMATICHE S.P.A., Ozzano Dell'emilia (IT)

( * ) Notice: Subject to any disclaimer, the term of this patent is extended or adjusted under 35 U.S.C. 154(b) by 585 days.

(21) Appl. No.: 17/058,905

(22) PCT Filed: May 21, 2019

(86) PCT No.: PCT/EP2019/063136

§ 371 (c)(1),
(2) Date: Nov. 25, 2020

(87) PCT Pub. No.: WO2019/228870

PCT Pub. Date: Dec. 5, 2019

(65) Prior Publication Data

US 2021/0195949 A1 Jul. 1, 2021

(30) Foreign Application Priority Data

May 28, 2018 (IT) ..... 102018000005755

(51) Int. Cl.

| | |
|---|---|
| ***A24F 40/10*** | (2020.01) |
| ***A24F 40/48*** | (2020.01) |
| *A24F 40/50* | (2020.01) |

(52) U.S. Cl.
CPC ..... *A24F 40/10* (2020.01); *A24F 40/48* (2020.01); *A24F 40/50* (2020.01)

(58) Field of Classification Search
CPC ..... A24F 40/10; A24F 40/60; A24F 40/65; A24F 40/51
See application file for complete search history.

(56) References Cited

U.S. PATENT DOCUMENTS 3,085,145 A * 4/1963 Wray, Jr. ..... A61M 11/044 392/406
9,681,287 B2 * 6/2017 Yang ..... H04W 4/021
(Continued)

FOREIGN PATENT DOCUMENTS

DE 102011076864 A1 12/2012
EP 2354052 A1 8/2011
(Continued)

OTHER PUBLICATIONS

Int'l Search Report and Written Opinion dated Nov. 19, 2019 in Int'l Application No. PCT/EP2019/063136.

*Primary Examiner* — Phuong Chi Thi Nguyen
(74) *Attorney, Agent, or Firm* — Panitch Schwarze Belisario & Nadel LLP

(57) ABSTRACT

An apparatus and method to automatically insert a liquid inside components of inhalers, such as cartomizers for electronic cigarettes, includes injection means having a plurality of injectors each having an injection head having a substantially symmetrical conformation with respect to its symmetrical axis. The injection means are configured to cooperate with an empty end part of a component and at least one injection needle is configured to penetrate into an internal cavity of the component and inject the liquid, while said injection head is stationary with respect to said component, arranging itself with the symmetrical axis substan-
(Continued)

tially coincidental with the longitudinal axis of said internal cavity.

18 Claims, 7 Drawing Sheets

(56) References Cited

U.S. PATENT DOCUMENTS

| | | | | |
|---|---|---|---|---|
| 9,927,452 | B2 | 3/2018 | Watson et al. | |
| 2017/0042232 | A1* | 2/2017 | Gorilovsky ..... | G01N 27/041 |

FOREIGN PATENT DOCUMENTS

| | | | |
|---|---|---|---|
| WO | 2014105951 | A1 | 7/2014 |
| WO | 2015028815 | A1 | 3/2015 |
| WO | 2015186000 | A2 | 12/2015 |

* cited by examiner

APPARATUS AND METHOD TO AUTOMATICALLY INSERT A LIQUID IN COMPONENTS FOR INHALERS; IN PARTICULAR CARTOMIZERS FOR ELECTRONIC CIGARETTES

CROSS-REFERENCE TO RELATED APPLICATIONS

This application is a Section 371 of International Application No. PCT/EP2019/063136, filed May 21, 2019, which was published in the English language on Dec. 5, 2019, under International Publication No. WO 2019/228870 A1, which claims priority under 35 U.S.C. § 119(b) to Italian Application No. 102018000005755, filed May 28, 2018, the disclosures of each of which are incorporated herein by reference in their entireties.

FIELD OF APPLICATION

The field of application of the present invention is that of apparatuses and methods for the automatic insertion of a liquid inside components of inhalers. In particular, but not only, said components can comprise cartomizers for electronic cigarettes, in other words objects each composed of a cartridge containing an atomizer that is able to transform the liquid it contains into vapour by means of a heating element, for example an electrical resistance.

STATE OF THE ART

In the field of inhalers in general and electronic cigarettes in particular, one component that receives particular attention from the manufacturers of such products is the so-called cartomizer, a cartridge of a substantially tubular form that contains an atomizer that is able to selectively transform into vapour a particular liquid that is also contained by that same cartridge.

In the case of electronic cigarettes the size of a single cartridge is substantially equivalent to the size of a regular tobacco cigarette, for example having a length of approximately 60 mm and an external diameter of approximately 9 mm and an outward surface with a tactile and aesthetic finish that will be appreciated by the user.

Furthermore each cartridge has openings at either end, through which it is possible to arrive at the elements contained by the cartridge, for example a small reservoir, or receptacle, for the liquid that is to be vaporized, and the electric and electronic parts of the atomizer.

In some cases said receptacle comprises an absorbent material, for example a piece of felt.

One of the technical problems that designers of machines for the insertion of a liquid into said components of inhalers have to face and solve is that of executing the operation of insertion of the liquid in an extremely precise manner, given the small dimensions of the components to be filled and the parts that constitute them.

Another technical problem is the high level of productivity that should be obtained with an apparatus for the automatic insertion of a liquid inside said components, so that the production cost of each single component is sufficiently low to make the component competitive in the market. By way of example, a target value for said productivity could be 1,000 components to be filled with liquid per minute, which means that the apparatus must be able to automatically treat a component approximately every 6 hundredths of a second.

The machines of the current state of the art are not able to resolve said technical problems and obtain said goal.

One goal of the present invention is therefore to provide an apparatus and a related method for the automatic insertion of a liquid inside components of inhalers, in particular, but not only, cartomizers for electronic cigarettes, which, overcoming the drawbacks of the prior art, is fast and reliable.

Another goal of the present invention is that of providing an apparatus and a related method for the automatic insertion of a liquid inside components of inhalers, in particular, but not only, cartomizers for electronic cigarettes, that also has a high level of productivity, in the order of filling 1,000 inhalers per minute with liquid.

To overcome the drawbacks of the prior art and to obtain these and other goals and advantages, the applicant has studied, experimented and created the machine and set up the method in accordance with the present invention.

SUMMARY OF THE INVENTION

The present invention is described and characterized in the independent claims, whereas the dependent claims present other characteristics of the present invention, or variants on the idea of the main solution.

In accordance with said goals, an apparatus for the automatic insertion of a liquid inside components for inhalers comprises injection means having one or more injectors. In particular, said components can be cartomizers for electronic cigarettes, each having a central body, preferably of tubular shape, having an axial cavity that has an empty end part and an internal part in which a receptacle is placed, configured to receive said liquid.

In accordance with one characteristic of the present invention, each injector comprises at least an end configured to be selectively inserted into the empty end part of said axial cavity and at least one injection needle configured to move with respect to said end in order to penetrate said receptacle and selectively inject the liquid, while said end is stationary and inserted into the empty end part of said axial cavity.

In accordance with another characteristic of the present invention, a first transporting member, associated with the apparatus, or being part of it, is configured to selectively transport, with incremental advances having a specific pitch, a first number of said components at a time, toward a removal position associated with said injection means. Moreover, the apparatus comprises a second transporting member substantially parallel to said first transporting member and configured to selectively transport, with incremental advances with said pitch, a second number of components at a time, towards said injection means, in which said second number is a whole multiple of said first number.

In accordance with another characteristic of the present invention, the components are aligned on said first transporting member along a longitudinal axis, separated from each other with a determinate interaxis, in which said pitch is equal to said interaxis for said first number. Moreover, said second transporting member comprises a chain consisting of a plurality of links articulated to each other and each having an interaxis that is a whole submultiple of the aforementioned pitch.

In accordance with a further characteristic of the present invention, in each of said links there is a plurality of seats each configured to accommodate one of said components;

moreover, said seats are distributed on a number of parallel rows with respect to each other that is equal to said whole multiple.

In accordance with another characteristic of the present invention, in each of said links the number of said seats for each of said rows is equal to said whole multiple.

It should be noted that in this manner the second transporting member defines accumulation means of the cartomizers because it allows a number of cartomizers equal to said second number to be processed, at least during the step of injecting the liquid into the cartomizers.

In accordance with another characteristic of the present invention, said injection means comprise a number of injectors that is equal to said second number and said injectors are arranged according to a regular matrix consisting of a number of parallel rows corresponding to that of said seats for a number of injectors per row which is equal to said first number.

In accordance with another characteristic of the present invention, the apparatus also comprises first gripping and positioning means arranged upstream of said injection means and configured to selectively move a number of said components at a time, equal to said first number, from said first transporting member to said second transporting member.

In accordance with another characteristic of the present invention, the apparatus also comprises second gripping and positioning means arranged downstream from said injection means and configured to selectively move a number of said components at a time, equal to said first number, from second transporting member to said first transporting member.

In accordance with another characteristic of the present invention, a method for the automatic insertion of a liquid inside the components of inhalers, in particular cartomizers per electronic cigarettes, in which each of said components comprises a central body, preferably of tubular shape, having an axial cavity that has an empty end part and an internal part in which a receptacle is arranged that is configured to receive said liquid, comprising an injection step during which the injection means having one or more injectors are activated.

In particular, said injection step comprises a first injection sub-step in which the end of each of said injectors is selectively inserted into the empty end part of said axial cavity together with at least one injection needle, and a second injection sub-step, in which said at least one injection needle performs an outward travel during which it is made to exit from said end to penetrate said receptacle and selectively inject said liquid into the latter, while said end remains stationary and inserted into the empty end part of said axial cavity. In one embodiment, the injection step furthermore comprises a third injection sub-step in which the injection needle performs a return travel during which it retracts from the receptacle to return into said end. In the third injection sub-step it is provided that the liquid is injected by means of said injection needle during at least a part of said return travel. Thanks to this third injection sub-step it is possible to imbue the receptacle with liquid in a manner more evenly distributed along a vertical direction. Moreover, said third injection sub-step makes it possible to optimise the overall injection cycle times because part of the injection cycle is temporally superimposed on the return movement of the injection needles.

DESCRIPTION OF THE DRAWINGS

These and other characteristics of the present invention will become clear in the following description of a preferred embodiment, provided solely as non-limiting example, with reference to the enclosed drawings, wherein.

It is pointed out that in the present description and in the claims the terms above, below, vertical, horizontal, upper, lower, internal, and external and variations thereon only serve to better illustrate the present invention with reference to the figures, and should not be used in any way to limit the scope of the invention itself or the scope of protection as defined by the claims. For example, the term horizontal indicates a plane that can be either parallel to the horizon, or at an inclined angle, also by a substantial degree, to said horizon.

DESCRIPTION OF AN EMBODIMENT OF THE PRESENT INVENTION

Figure 1:
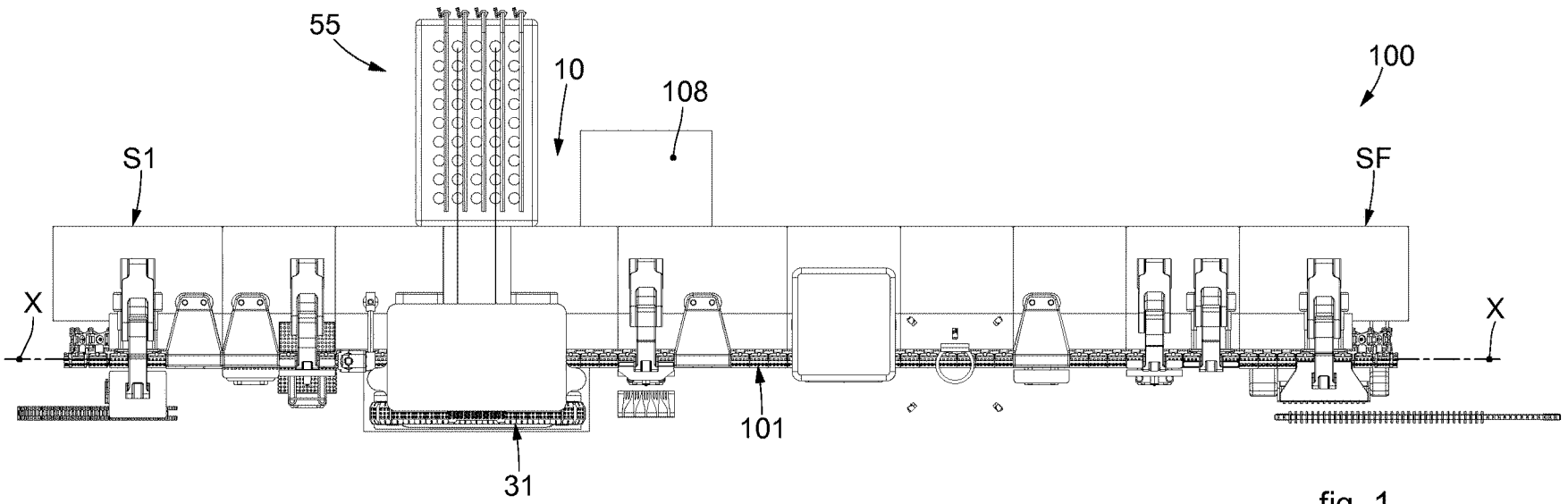
FIG. 1 is a schematic plan view of a machine for the automatic treatment of components for inhalers, in particular cartomizers for electronic cigarettes, comprising an apparatus for the automatic insertion of a liquid inside components, according to the present invention.
Figure 2:
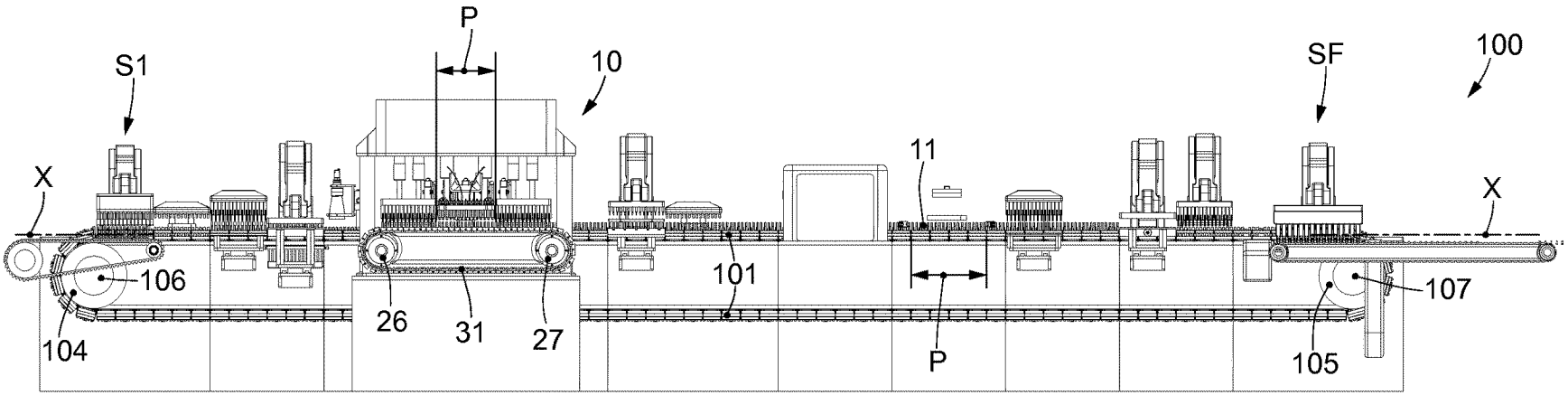
FIG. 2 is a schematic front view of the machine of FIG. 1.
Figure 3:
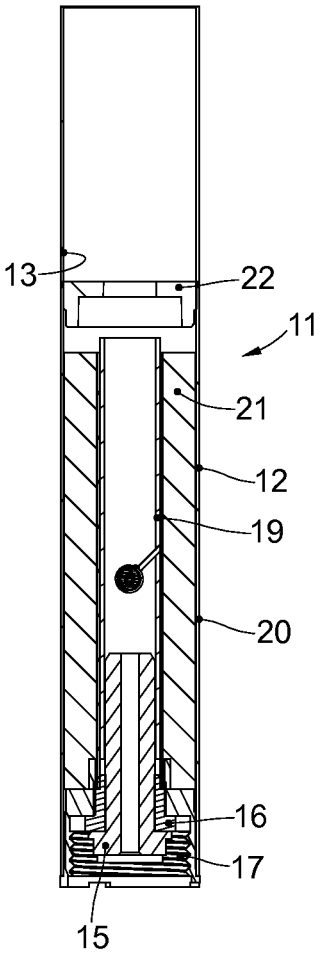
FIG. 3 is a schematic longitudinal cross-section view of a cartomizer that can be treated by the apparatus of FIG. 1.
Figure 4:
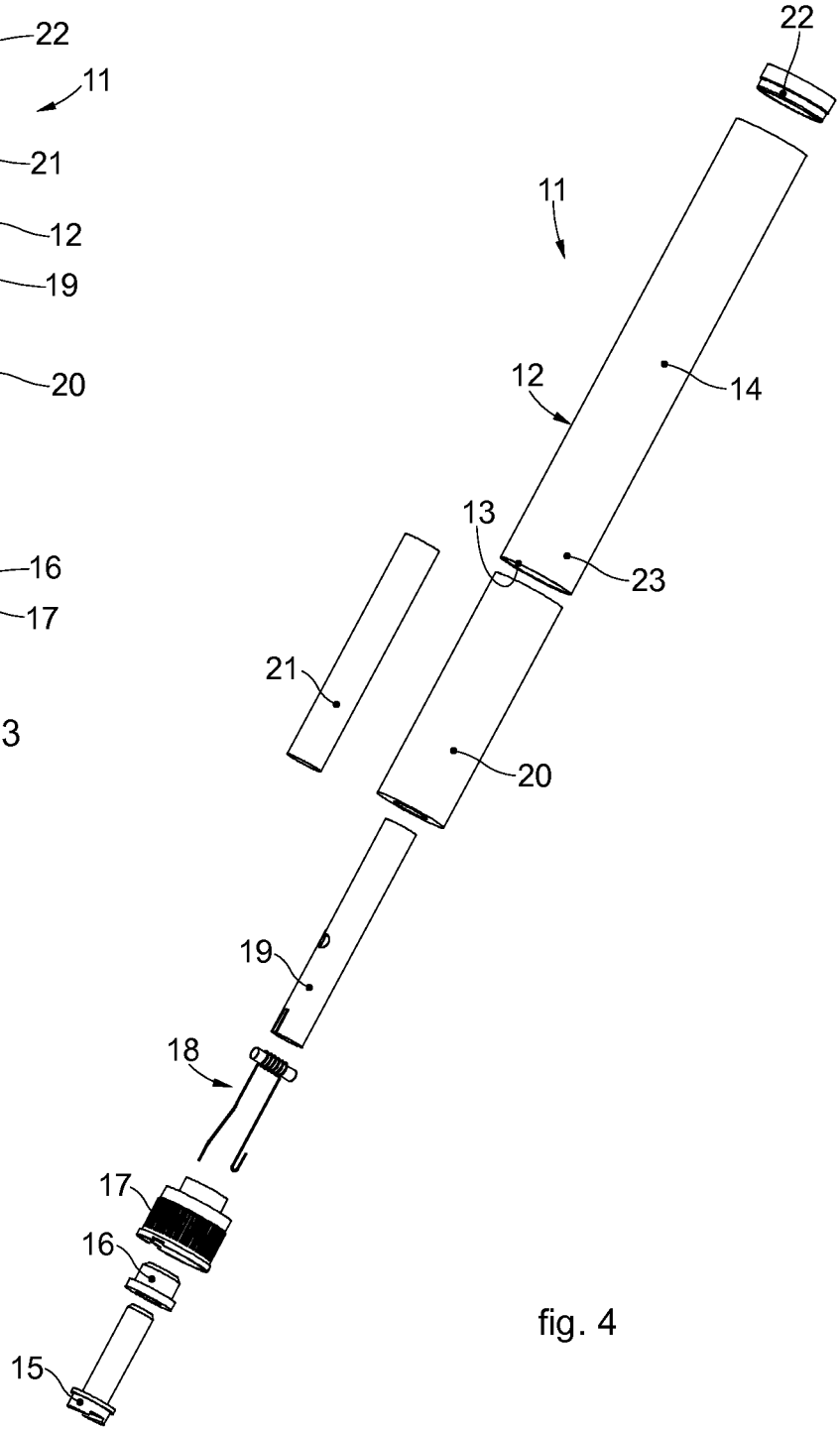
FIG. 4 is an exploded view of the elements composing the cartomizer of FIG. 3.

With reference to FIGS. 1 and 2, a machine 100 (FIGS. 1 and 2) configured for the treatment of components for inhalers, for example cartomizers 11 (FIGS. 3 and 4) for electronic cigarettes is described. The machine 100 comprises a plurality of work stations, including a filling station comprising an apparatus 10 in accordance with the present invention, to automatically insert a liquid inside said components.

To better understand the inventive concept of the present invention, before describing in detail the apparatus 10 and a part of the machine 100 and the related methods, first an example of the construction of a complete cartomizer 11 (FIGS. 3 and 4) will be described, it being understood that the present invention is not limited to this example, but it can be used for the automatic insertion of a liquid inside any component of inhalers that are already known or that will be developed in the future.

By way of example a cartomizer 11 comprises a central body 12 of tubular shape, having an internal cavity 13 that extends along a longitudinal axis C and that is closed at one of its ends, and an external surface 14, treated in a known manner to be pleasant to touch and have an aesthetic appearance. In the example given here, the cartomizer 11 has a length of approximately 60 mm and an external diameter of approximately 9 mm, and the thickness of the cylindrical wall of the central body 12 is approximately 0.2 mm.

In the lower part of the cavity 13 there are—from the bottom to the top in FIG. 2—a metal ring 15 that functions as electrode, a ring of isolating material 16, a cap 17, hollow on the inside and threaded on the outside, and a heating unit 18 connected to the metallic ring 15. Furthermore, around the heating unit 18 a tubular element 19 made of glass fibre is arranged. Coaxial with the latter and against the internal wall of the cavity 13 a bushing 20 made of a plastic material, e.g. polyester, is arranged. In the annular space between the tubular element 19 and the bushing 20 a cotton felted cloth 21 is arranged, which is configured to be imbued with a specific liquid, for example containing natural or artificial essences, and/or some other substance, destined to become vaporized during the selective activation of the heating unit 18. A blocking ring 22 is intended to be arranged over the felted cloth 21 after the latter has been imbued with liquid.

The upper end part of the cavity 13 is empty for a depth of approximately 8-9 mm and is configured to potentially accommodate a tobacco capsule, or some other substance that is suitable to provide a specific flavour to the vapour that the user inhales by drawing air through the upper end of the cartomizer 11.

The machine 100 (FIGS. 1 and 2) comprises, for example, a first transporting member 101 configured to selectively transport the cartomizers 11 along a path, for example straight and horizontal, defined by a longitudinal axis X, from a loading station S1 towards the apparatus 10 and from this towards a final station SF.

The first transporting member 101 consists of, for example, a first chain 102 (FIGS. 5 and 6), made of links 103 that are articulated to each other and stretched between two first toothed wheels 104 and 105 (FIG. 2), arranged on a vertical plane passing through the longitudinal axis X and each connected to a corresponding electric motor 106 and 107, schematically rendered in FIG. 2.

The cartomizers 11 are arranged in the first chain 102 (FIGS. 6 and 8) and already vertically aligned one behind the other, and correctly oriented, i.e. with the empty upper end part of the internal cavity 13 turned upwards, and without any protective elements such as caps or other, which may have been applied previously to each central body 12.

In particular, for example, each link 103 carries a slider 109 having five seats 110, configured to assume a vertical position when they are aligned along the longitudinal axis X to support five corresponding cartomizers 11. By way of example the interaxis IC between two adjacent seats 110 is approximately 19 mm, so that the length of each slider 109, in the direction of the longitudinal axis X, which corresponds to the interaxis IM1 (FIG. 5) between the links 103, is approximately 95 mm.

A central control unit 108, schematically rendered in FIG. 1, is configured to control and send commands to, among other things, the two motors 106 and 107 (FIG. 2), so that the first chain 102 advances in a stepped manner, i.e. at discrete increments, from the loading station S1 to the final station SF, as will be described in detail below. In particular, in the example given here, the central control unit 108 is configured to have the first chain 102 carry out, at each pitch P (FIG. 2), an incremental advance that corresponds to the length of three sliders 109, i.e. approximately 285 (P=3 IM1), so that at each pitch P a first number N1 of cartomizers 11 is moved; in the example given here this number is fifteen.

The apparatus 10 comprises a fixed structure 23 (FIGS. 6, 7, 8 and 12) arranged in front to the first transporting member 101 and having a vertical wall 24, substantially parallel to the longitudinal axis X, and a horizontal support plane 25.

On the anterior part of the vertical wall 24 two second toothed wheels 26 and 27 (FIG. 5) are rotatably mounted, arranged on a vertical plane that is parallel to the plane passing through the longitudinal axis X.

Onto the toothed wheels 26 and 27 a second transporting member 31 is mounted, consisting, for example, of a second chain 32 made of links 33 articulated to each other.

Figure 5:
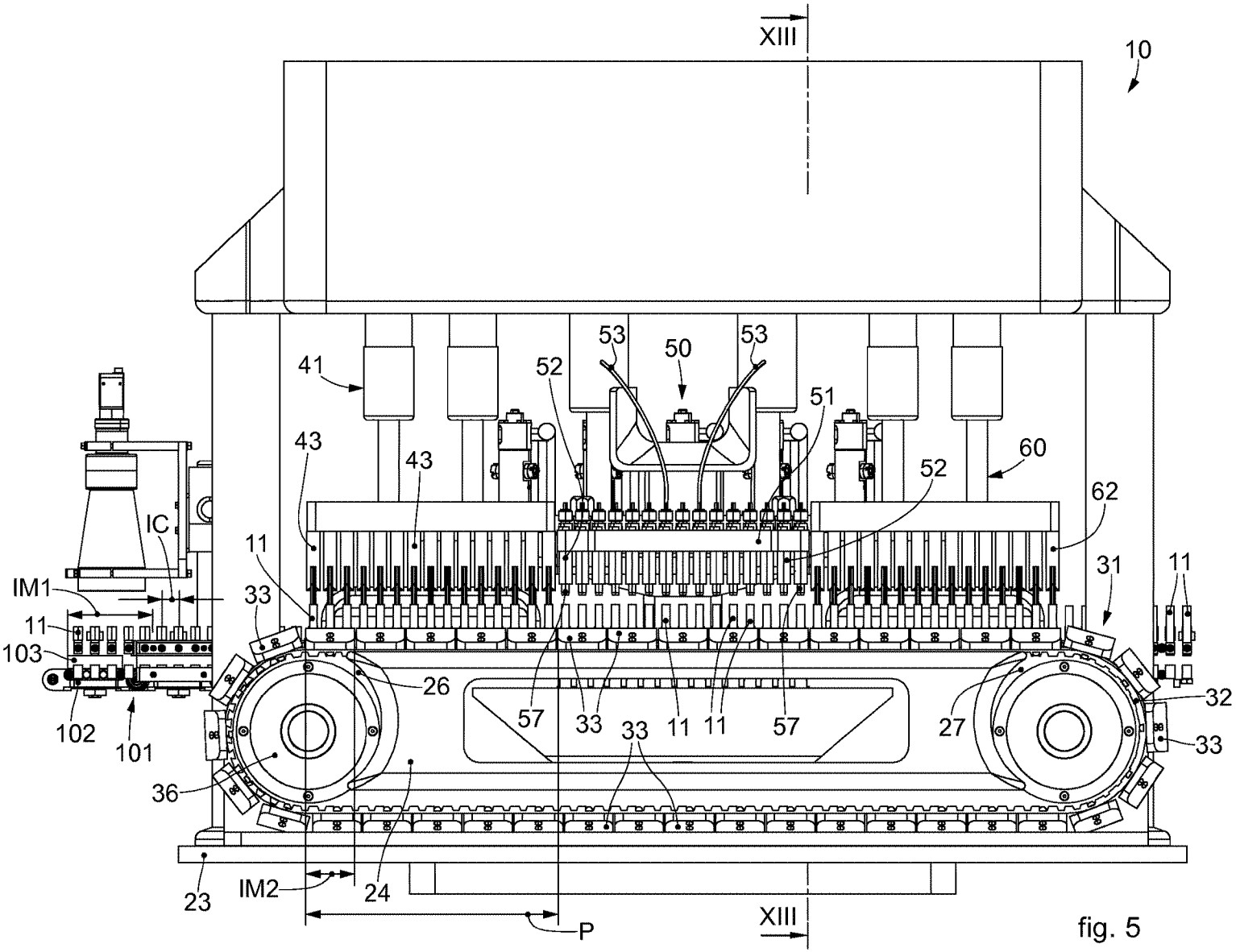
FIG. 5 is an enlarged front view of an apparatus for the automatic insertion of a liquid inside components for inhalers according to the present invention.

An electric motor 36, schematically rendered in FIG. 5 and controlled, for example, by the same central control unit 108, is connected to the two second toothed wheels 26 and 27 to selectively make them rotate in a clockwise direction so that the second chain 32 performs incremental advances having the same pitch P as the first transporting member 101. Alternatively the electric motor 36 can be controlled by another control unit, not represented in the drawings, as long as this motor is synchronized with the controls of the electric motors 106 and 107. Furthermore, instead of a single electric motor 36, it is also possible to use two electric motors 36 (not represented in the drawings), one associated with the toothed wheel 26 and one with the toothed wheel 27.

Different from the links 103 of the first chain 102, each link 33 of the second chain 32 has a smaller length and the interaxis IM2 between two adjacent links 33 is equal to pitch P divided by a whole submultiple SM, which in the example given here is five, so that the interaxis IM2 is approximately 57 mm.

Each link 33 comprises nine cylindrical seats 37 (FIG. 6), arranged aligned in three regular rows, i.e. three cylindrical seats 37 per row. The seats 37 are configured to assume a vertical position when they are aligned parallel to the longitudinal axis X, each to accommodate cartomizer 11. The interaxis between two adjacent cylindrical seats 37 is equal to the interaxis between two adjacent seats 110. Therefore, in the example provided here, the second transporting member 31 at each pitch P is capable able of advancing a second number N2 of cartomizers 11 at a time, which is a whole multiple MI of said first number N1 of cartomizers 11. In the present description MI is equal to the number of rows of seats 37, i.e. three, so that N2 is equal to forty-five.

The support plane 25 is provided on its left side, i.e. towards the loading station S1 (FIG. 1), of a first group of fixed vertical seats 38 (FIG. 6), equal to said first number N1, aligned in a single row that is parallel to the longitudinal axis X, to temporarily accommodate said first number N1 of cartomizers 11 to be filled with the liquid, and on the right side, i.e. towards the final station SF (FIG. 1), a second group of fixed vertical seats 39 (FIG. 12), also equal to said first number N1, aligned with the fixed vertical seats 38 and configured to temporarily accommodate said first number N1 of cartomizers 11 already filled with said liquid. The interaxis between two adjacent fixed vertical seats 38 and the one between two adjacent fixed vertical seats 39 are both equal to the interaxis IC between two adjacent seats 110.

The apparatus 10 also comprises first gripping and positioning means 40 (FIGS. 6 and 8) and second gripping and positioning means 41, identical to each other and, for example, of the kind known to persons skilled in the art by the term "pick and place" or "P&P", which are aligned along a first transverse axis Y1 (FIG. 8), substantially horizontal and perpendicular to the longitudinal axis X.

Each gripping and positioning means 40 and 41 has a number of grippers 42 and 43 respectively, that is equal to said first number N1 of cartomizers 11. The grippers 42 and 43 can be selectively operated, under the control of the central control unit 108, to raise and lower themselves together, or each to grip a cartomizer 11, as will be described in detail below.

In particular, the first gripping and positioning means 40 are also configured to contemporaneously transfer said first number N1 of cartomizers 11 at a time, along the first transverse axis Y1, after having lifted them from the seats 110 of the sliders 109, and then to place them, by contemporaneously lowering them, on the corresponding fixed vertical seats 38, as will be explained in detail below.

The second gripping and positioning means 41 on the other hand are configured to contemporaneously transfer said first number N1 of cartomizers 11 at a time, along the first transverse axis Y1, and then to place them, by contemporaneously lowering them, on the corresponding cylindrical seats 37 of the links 33, after having lifted them from the fixed vertical seats 38, as will be explained in detail below.

Furthermore the apparatus 10 comprises injection means 50 (FIGS. 5, 6, 7 and 9), which comprise a support 51, vertically movable, onto which a plurality of injectors 52 is mounted, whose number is equal to said second number N2 of cartomizers 11, arranged in a regular manner on a matrix of three rows parallel to the longitudinal axis X, i.e. a first number N1 of injectors 52 for each row, to contemporaneously insert by injection a determined liquid into said second number N2 of cartomizers 11 at a time. The interaxis between two adjacent injectors 52 is equal to the interaxis between two adjacent cylindrical seats 37 of the links 33, which, as previously described, is equal to the interaxis IC between two cartomizers 11 in the first transporting member 101.

Each injector 52 is connected, by means of a conduit 53, to a pump 54 (FIG. 7) of a pumping unit 55 arranged in a rear zone with respect to the second transporting member 31 and also comprising a tank 56 for the liquid that is to be injected.

Figure 10:
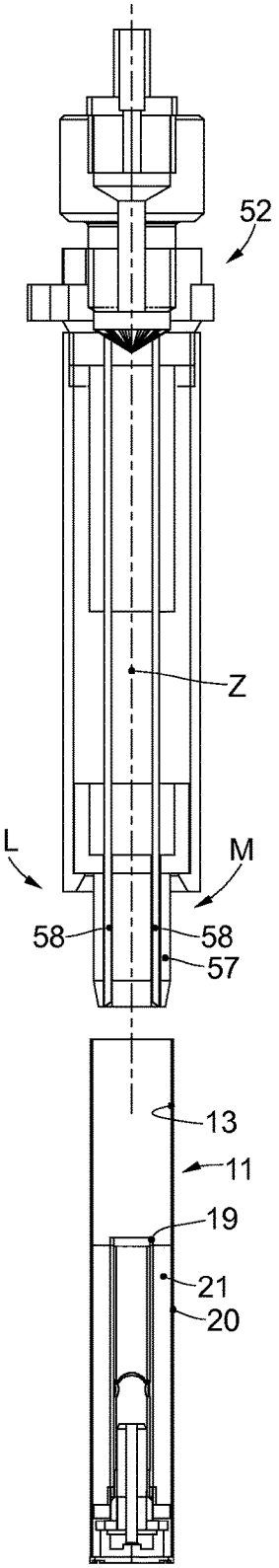
FIGS. 10 and 11 are longitudinal cross-sections of an injector of the apparatus of FIG. 5, which illustrate the injector in various operational configurations.
Figure 11:
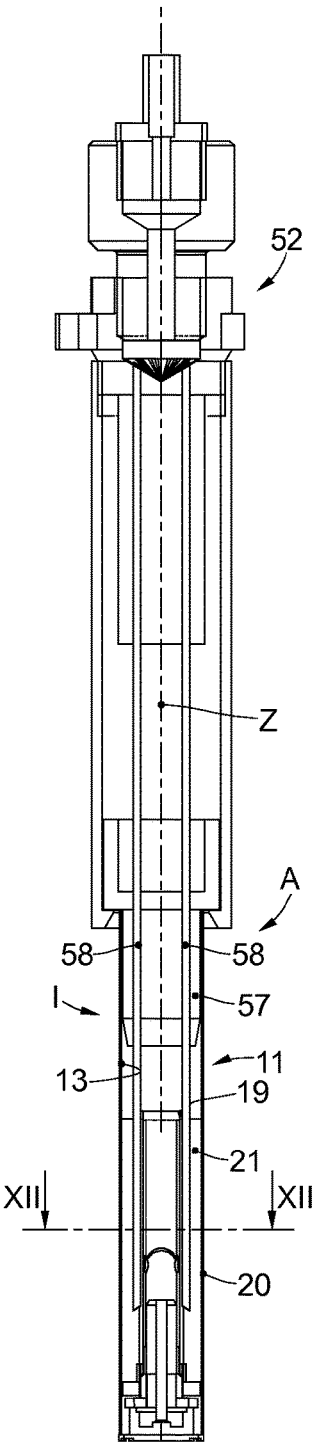
Figure 13:
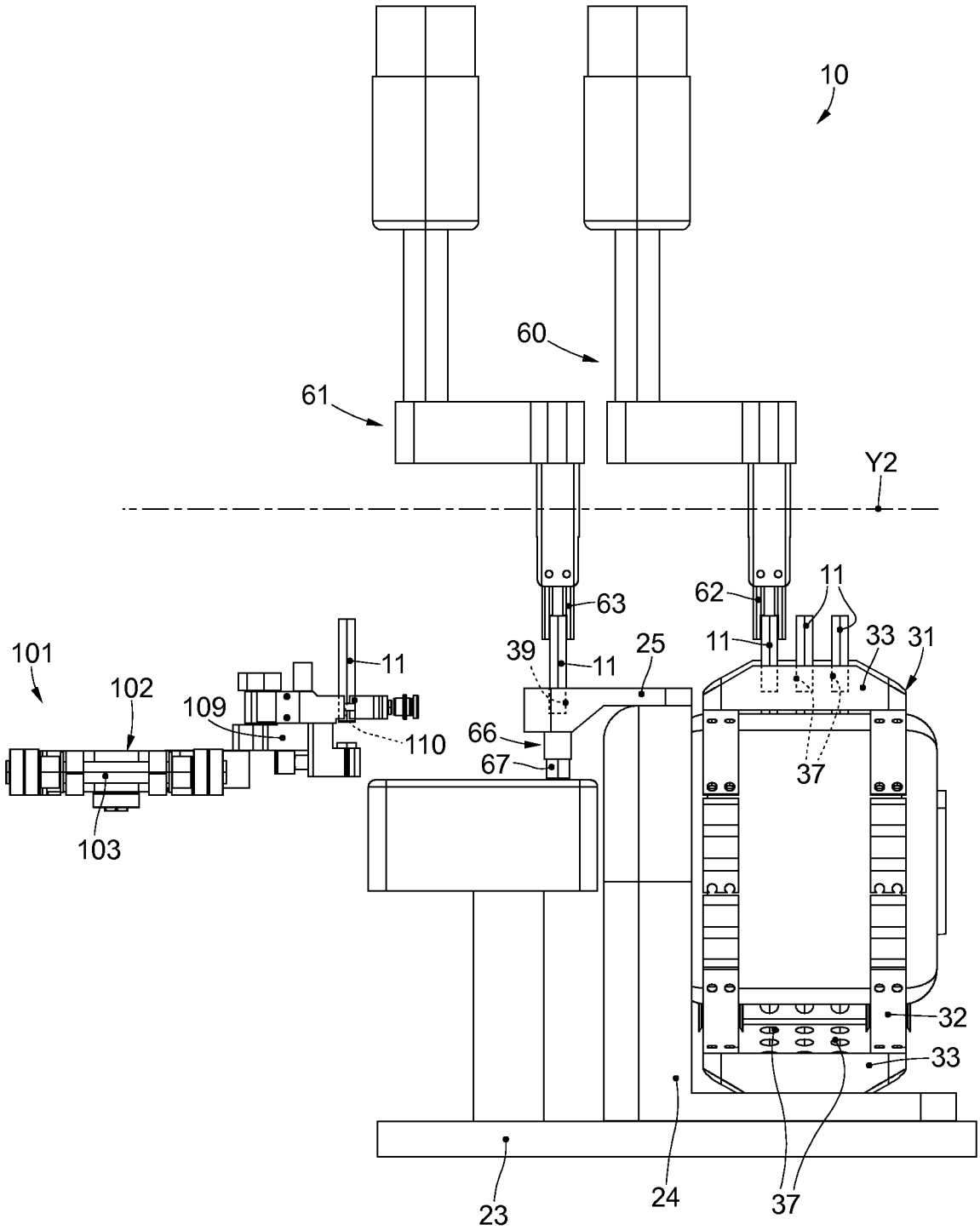
FIG. 13 is a transverse cross section along the line XIII-XIII of FIG. 5.

Furthermore each injector 52 comprises at its extremity an injection head 57 (FIG. 10), having a symmetrical conformation with respect to its symmetrical axis Z. Preferably the injection head 57 has an external diameter that is slightly smaller than the internal diameter of the internal cavity 13 of a cartomizer 11, and three vertical injection needles 58 arranged at angular offsets to each other of 120° (FIGS. 10 and 11) and at a certain distance, or radius, R (FIG. 11) from the symmetrical axis Z, arranged vertically, so that they can contemporaneously be inserted into the felted cloth 21 of a cartomizer 11, between the tubular element 19 and the bushing 20 to inject into said felted cloth 21 the liquid coming from the pumping unit 55. In the example given here the radius R is approximately 3.25 mm.

The support 51 (FIGS. 5, 6 and 8) is configured to move vertically between a rest position M, raised, in which all the injection heads 57 of the N2 injectors 52 are completely outside of the underlying N2 cartomizers 11, and a lowered operational position L (FIGS. 11 and 12), in which the injection heads 57 of the N2 injectors 52 are completely inside of the upper part of the internal cavity 13 of the underlying N2 cartomizers 11.

In an embodiment not illustrated here, the injection heads 57 can cooperate with the respective internal cavities 13 without inserting themselves into their interior, for example by externally enclosing the upper part of the internal cavities 13.

Additionally the injection means 50 are configured so that the injection needles 58 of all the N2 injectors 52 are also contemporaneously movable between an inactive position I, in which their tips are inside the corresponding injection head 57 (FIG. 10), and an active position A (FIGS. 11 and 12), in which they have exited from the latter and are inside the corresponding felted cloth 21 to inject the liquid into it. The apparatus 10 furthermore comprises third gripping and positioning means 60 and fourth gripping and positioning means 61 (FIGS. 5 and 12), analogous to the gripping and positioning means 40 and 41, which are however aligned along a second transverse axis Y2 (FIG. 12), parallel to the first transverse axis Y1 and arranged downstream from the injection means 50, i.e. towards the final station SF.

Each gripping and positioning means 60 and 61 is provided with a number of grippers 62 and 63 respectively, equal in number to said first number N1 of cartomizers 11. The grippers 62 and 63 are selectively operated, under the control of the central control unit 108, to raise and lower themselves together, or to grip each a cartomizer 11, as will be explained in detail below.

In particular, the third gripping and positioning means 60 are also configured to contemporaneously transfer, along the second transverse axis Y2, N1 cartomizers 11 at a time, after the liquid has been injected into the latter and they have been lifted from the cylindrical seats 37 of the links 33, and then to place them, by contemporaneously lowering them, on the N1 fixed vertical seats 39, as will be explained in detail below.

The fourth gripping and positioning means 61 on the other hand are configured to contemporaneously transfer N1 cartomizers 11 at a time along the second transverse axis Y2 and then to place them, by contemporaneously lowering them, on the corresponding N1 seats 110 of the sliders 109, after having lifted them from the fixed vertical seats 39, as will be explained in detail below.

Furthermore, associated with the first group of fixed vertical seats 38 a first weighing device 64 is present (FIGS. 6 and 8), which comprises a number N1 of load cells 65, each arranged at the bottom of a corresponding fixed vertical seat 38 and configured to weigh the cartomizer 11 inserted into it, in order to determine the weight of the respective cartomizer 11, or its tare before the liquid is inserted into it.

Associated with the second group of fixed vertical seats 39 a second weighing device 66 (FIG. 12) is present, which comprises a number N1 of load cells 67, each arranged at the bottom of a corresponding fixed vertical seat 39 and configured to weigh the cartomizer 11 inserted into it, to determine its gross weight after the liquid has been introduced by the injection means 50.

The load cells 65 and 67 are all connected to the central control unit 108, which is programmed to determine the effective weight of the liquid inserted into each cartomizer 11 and to detect any cartomizers 11 in which the quantity of inserted liquid is outside of a certain tolerance, to discard them in any of the known manners before they arrive at the final station SF.

The functionality of the apparatus 10 described so far, which also defines the method for automatically inserting a liquid inside components for inhalers, in particular in cartomizers 11 for electronic cigarettes, is as follows.

Figure 8:
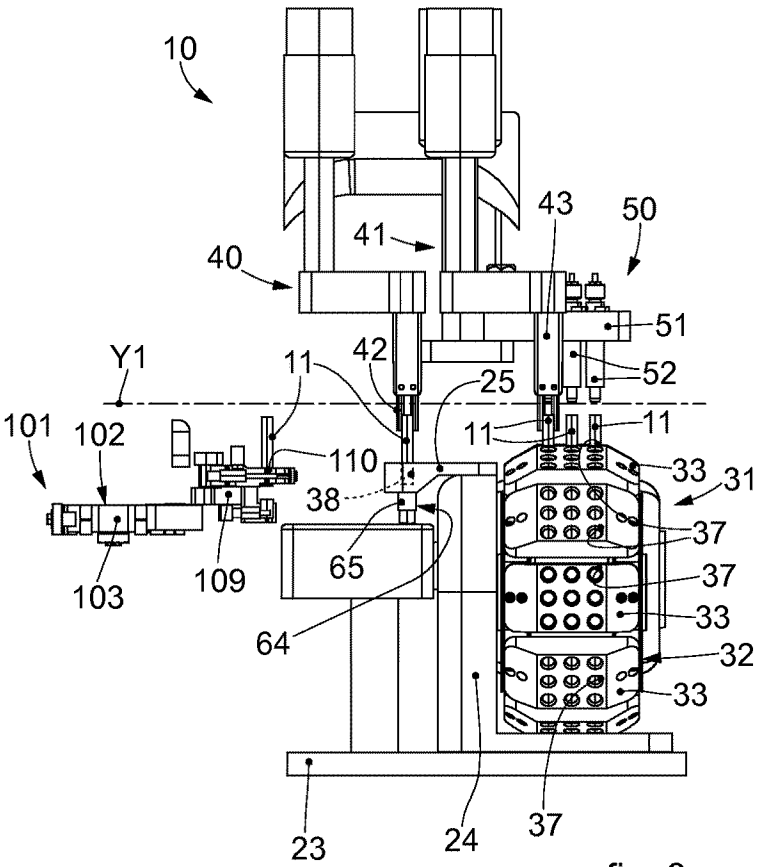
FIG. 8 is a first enlarged detail of FIG. 7.
Figure 6:
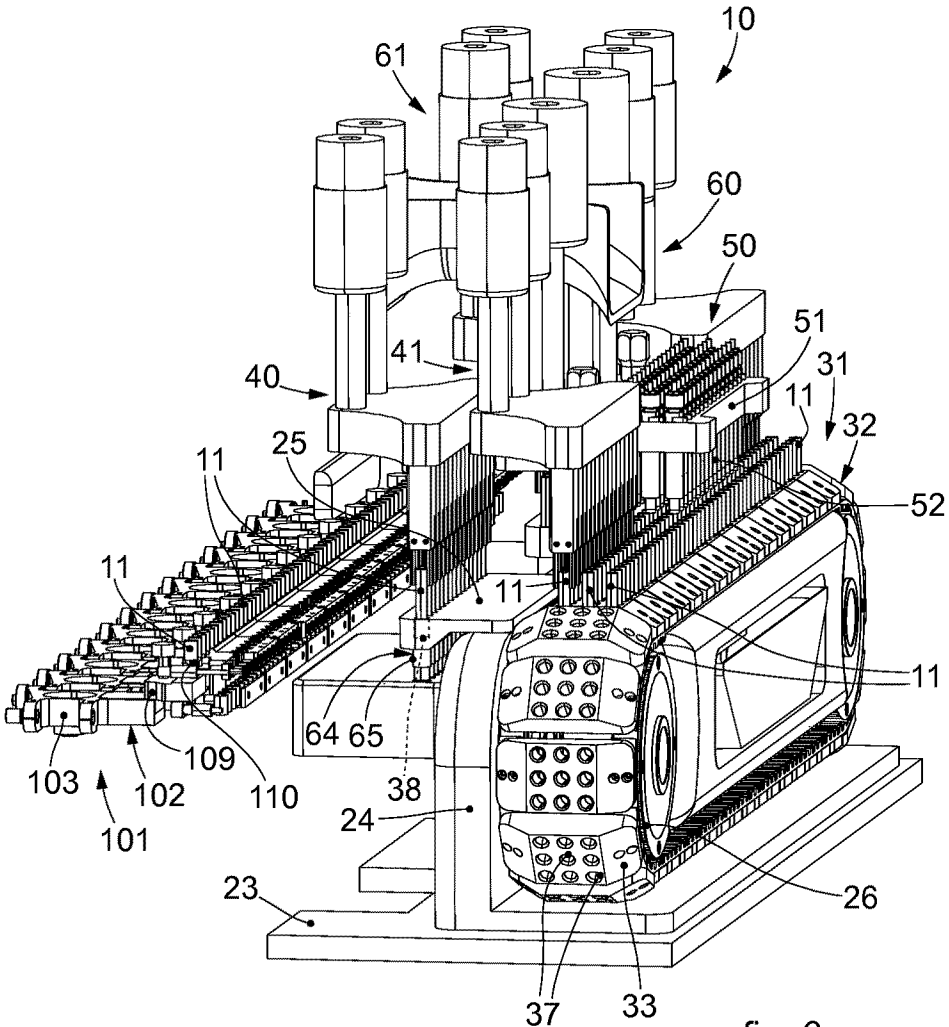
FIG. 6 is a perspective view of the apparatus of FIG. 5.
Figure 7:
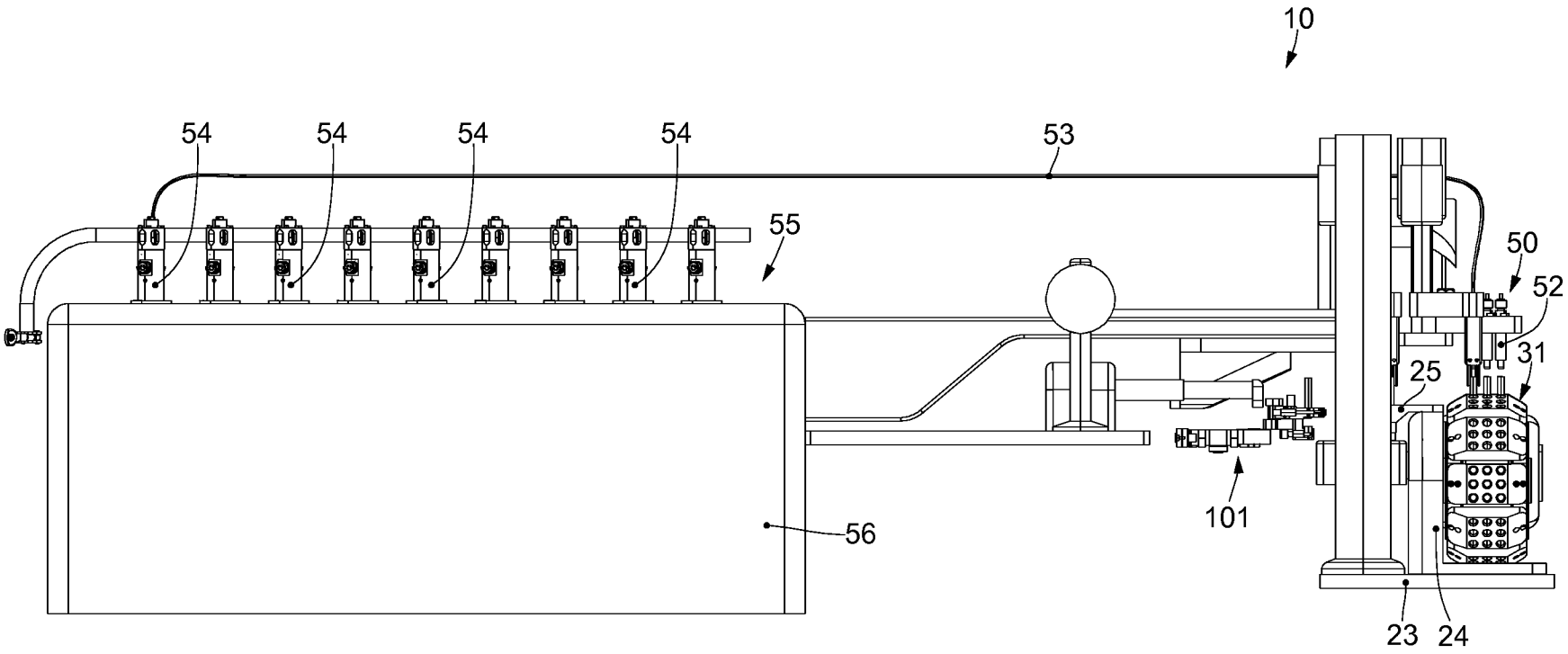
FIG. 7 is a left side view of the apparatus of FIG. 5.
Figure 9:
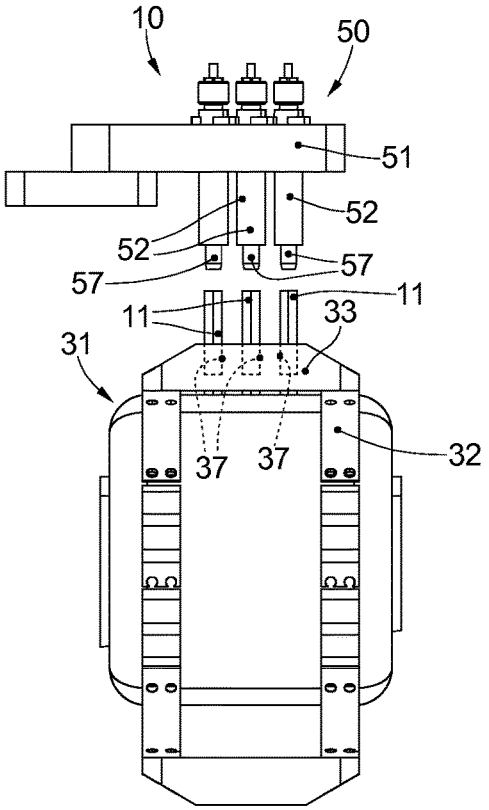
FIG. 9 is a second enlarged detail of FIG. 7.
Figure 12:
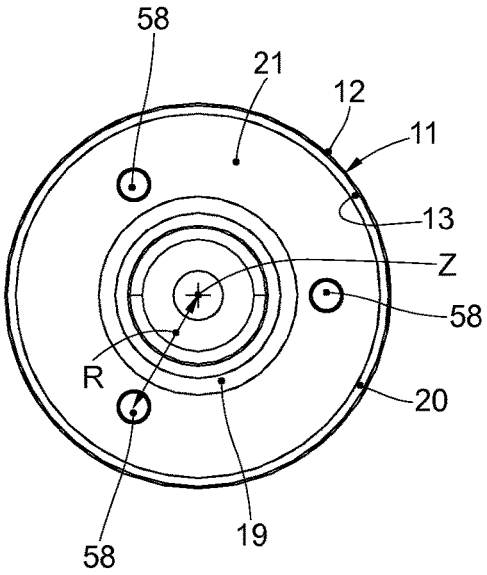
FIG. 12 is a schematic cross section along the cross-sectional plane XII-XII of FIG. 11, in which it is visible how the injection needles are inserted inside the cartomizer of FIG. 2.

First of all the cartomizers 11, each still without the blocking ring 22 (FIG. 3), into which a determined liquid contained in the tank 57 (FIG. 7) is to be injected by the pumping unit 55, are made to advance, at incremental advancements having pitch P (FIG. 2) along the longitudinal axis X, by means of the first transporting member 101, until a first group of N1 cartomizers 11 is carried from the loading station S1 to a position that is termed the removal position of the apparatus 10, i.e. at the first gripping and positioning means 40 (FIGS. 6 and 8). This occurs by means of the central control unit 108 which sends the apposite commands to the electric motors 106 and 107 associated with the first toothed wheels 104 and 105.

By way of example, the speed of advancement V of the first transporting member 101 is very high, so that each of its incremental advancements which correspond to pitch P, are carried out very rapidly for each time interval T1, which in the example given here is approximately 0.9 seconds, so that the apparatus 10 can obtain a productivity of approximately 1,000 cartomizers 11 per hour.

Then, holding stationary both the first transporting member 101 and the second transporting member 31, the pick up step is executed, which involves a first transfer step to transfer, along the first transverse axis Y1 (FIG. 8), the first group of N1 cartomizers 11 up to carrying them, by means of the first gripping and positioning means 40, from the seats 110 of the sliders 109 to the fixed vertical seats 38 of the support plane 25.

Then, while the second transporting member 31 remains stationary, the first transporting member 101 is made to advance by one pitch P (FIG. 2), so that a second group of N1 cartomizers 11, immediately after the first one, is brought to said removal position.

The second gripping and positioning means 41 then transfer the first group of N1 cartomizers 11 along the first transverse axis Y1 until they are carried from the fixed vertical seats 38 to the outermost row, i.e. the one on the far right in FIG. 8, of the cylindrical seats 37 of the links 33 of the chain 32. Once the fixed vertical seats 38 have been emptied, by means of the first gripping and positioning means 40 the second transfer step is executed to transfer, along the first transverse axis Y1 (FIG. 8), the second group of N1 cartomizers 11 until they are carried from the seats 110 of the sliders 109 to the fixed vertical seats 38 of the support plane 25.

Then, while the second transporting member 31 still remains stationary, the first transporting member 101 is made to advance by an additional pitch P (FIG. 2), so that a third group of N1 cartomizers 11 is transferred, immediately after the second, to said removal position.

The second gripping and positioning means 41 then transfer the second group of N1 cartomizers 11 along the first transverse axis Y1 until they are carried from the fixed vertical seats 38 to the middle row of the cylindrical seats 37 of the links 33 of the chain 32. Once the fixed seats 38 have been emptied of the second group N1 of cartomizers 11, a third transfer step is executed to transfer, along the first transverse axis Y1 (FIG. 8), the third group of N1 cartomizers 11 and carry it, by means of the first gripping and positioning means 40, from the seats 110 of the sliders 109 to the fixed vertical seats 38 of the support plane 25.

Then, as the second transporting member 31 still remains stationary, the first transporting member 101 is made to advance by a further pitch P (FIG. 2), so that a fourth group of N1 cartomizers 11 is transferred, immediately after the third, to said removal position.

The second gripping and positioning means 41 transfer the third group of N1 cartomizers 11 along the first transverse axis Y1 until they are carried from the fixed vertical seats 38 to the innermost row, i.e. the one on the far left in FIG. 8, of the cylindrical seats 37 of the links 33 of the chain 32. After having in this manner emptied the fixed seats 38 of the third group N1 of cartomizers 11, a fourth transfer step is executed to transfer, along the first transverse axis Y1 (FIG. 8), the fourth group of N1 cartomizers 11 and carry it, by means of the first gripping and positioning means 40, from the seats 110 of the sliders 109 to the fixed vertical seats 38 of the support plane 25.

It should be noted that while each group of N1 is held stationary in the fixed seats 38, each of them is weighed individually, by means of the load cells 65, to determine their tare, i.e. the weight of the empty cartomizer 11.

Then an advancement by a further pitch P is executed for both the first transporting member 101, so that it carries a fifth group of N1 cartomizers 11 to the pick up position, and for the second transporting member 31, so that the N2 cartomizers 11 previously positioned in the cylindrical seats 37 of the links 33, i.e. N1 cartomizers for each of the three rows, are contemporaneously transferred to the right (FIG. 6) until they are carried to the N2 injectors 52 of the injection means 50.

It should be noted that thanks to said removal step of the cartomizers 11 and their transfer from the first transporting member 101 to the second transporting member 31, the N2 cartomizers 11 positioned on the latter are made to advance by a pitch P at a frequency that is a third of that for the advancement of the N1 cartomizers 11 positioned on the first transporting member 101, so that the N2 cartomizers 11 remain stationary in the injection means 50 for an injection time T2, which is three times said time interval T1. Therefore, in the example given here, said injection time T2 is approximately 2.7 seconds, which is long enough to execute the injection step and have the necessary quantity of liquid injected into each of the N2 cartomizers 11.

In this manner, thanks to the transfer sequence described above, the second transporting member 31 filled with cartomizers 11 defines accumulation means for the latter, seeing as it allows a number of cartomizer 11 to be accommodated and advanced at each incremental pitch P that is equal to said second number, i.e. equal to forty-five in the example given and illustrated here. On one hand this has the advantage that the second transporting member 31 can be made to advance more slowly, in particular at a speed of advancement that is equal to a third of the speed of advancement of the first transporting member 101. Subsequently the second transporting member 31 remains stationary at each pitch for a longer period of time, i.e. for a time long enough to allow the injection means 50 to inject the planned quantity of liquid inside the cartomizers 11, in particular contemporaneously inside a number of cartomizers 11 that is equal to said second number N2 for each injection cycle.

Then the actual injection step is executed, which comprises a first injection sub-step in which the support 51 is brought in the lowered operational position L, so that the injection heads 57 of the N2 injectors 52 enter into the corresponding internal cavities 13 of the N2 cartomizers 11. In a second injection sub-step all the injection needles 58 are then lowered (i.e. three injection needles 58 for each of the N2 injectors 52, in the example given here) until they are brought in the active position A, in which they have penetrated the felted cloths 21. Then the pumps 54 (FIG. 7) are activated so that into the felted cloths 21 (FIGS. 11 and 12) the liquid contained by the tank 56 (FIG. 7) is injected. While the pumps 54 continue to operate, all the injection needles 58 are advantageously lifted upwards gradually, or at incremental steps, so that the felted cloth 21 of each cartomizer 11 is fully imbued in a third injection sub-step. In other words, the injection of the liquid can take place both during the outward travel of the needles 58 sticking out of the injection heads 57 (second injection sub-step), and during the return travel of the needles 58 in which they retreat inside the injection heads 57 (third injection sub-step).

After the pumps 54 (FIG. 7) have ceased operation, all the injection needles 58 are contemporaneously brought to the inactive position I (FIG. 10), and the support 51 with all the N2 injectors 52 is brought to the rest position M.

During the injection step, the second transporting member 31 remains stationary, while the first transporting member 101 continues to advance at pitch P (FIG. 2) at a time, for three more turns. Contemporaneously the two gripping and positioning means 40 and 41 (FIG. 8) transfer other N2 cartomizers 11 (N1 at a time) from the first transporting member 101 to the fixed seats 58 of the support plane 25, and from these to the seats 37 in the links 33 of the second transporting member 31, in the manner described above. In this manner, during the injection step, other N2 cartomizers 11 are positioned in as many cylindrical seats 37 of the links 33.

After the injection step is finished, also the second transporting member 31 is made to further advance by pitch P towards the right (FIG. 6), so that the N2 cartomizers 11 that have just been filled with liquid are taken to a position for the removal from the second transporting member 31.

Then a removal step is executed on the N2 cartomizers 11 that have just been filled with liquid, to carry them, N1 at a time, into the seats 110 of the first transporting member 101. In particular, while the second transporting member 31 remains stationary for a time equal to the injection time T2 and the first transporting member 101 remains stationary for a time interval T1, a fifth transfer step is executed in which the third gripping and positioning means 60 (FIG. 12) pick up with their grippers 62 and then transfer, along the second transverse axis Y2, the third group of N1 cartomizers 11 to carry them from the innermost row, i.e. the one on the far right in FIG. 12, of the cylindrical seats 37 of the links 33 in which they were located, to the fixed vertical seats 39 of the support plane 25.

Then, while the second transporting member 31 still remains stationary, the first transporting member 101 is made to further advance by a pitch P (FIG. 2) towards the right. Then a sixth transfer step is executed, in which the fourth gripping and positioning means 61 (FIG. 12) pick up with their grippers 63 and then transfer, along the second transverse axis Y2, the third group of N1 cartomizers 11 to carry them from the fixed vertical seats 39 of the support plane 25 to the seats 110 of the sliders 109. Contemporaneously, the third gripping and positioning means 60 pick up with their grippers 62 and then transfer, along the second transverse axis Y2, the second group of N1 cartomizers 11 to carry them from the middle row of the cylindrical seats 37 of the links 33, in which they were located, to the fixed vertical seats 39 of the support plane 25.

Then, while the second transporting member 31 still remains stationary, the first transporting member 101 is made to further advance by a pitch P (FIG. 2) towards the right. Then a seventh transfer step is executed in which the fourth gripping and positioning means 61 (FIG. 12) pick up with their grippers 63 and then transfer, along the second transverse axis Y2, the second group of N1 cartomizers 11 to carry them from the fixed vertical seats 39 of the support plane 25 to the seats 110 of the sliders 109. Contemporaneously the third gripping and positioning means 60 take with their grippers 62 and then transfer, along the second transverse axis Y2, the first group of N1 cartomizers 11 to carry them from the outermost row, i.e. the one on the far right in in FIG. 12, of the cylindrical seats 37 of the links 33, in which they were located, to the fixed vertical seats 39 of the support plane 25.

Then, while the second transporting member 31 still remains stationary, the first transporting member 101 is made to further advance by a pitch P (FIG. 2) towards the right. Then the eighth transfer step is executed in which the fourth gripping and positioning means 61 (FIG. 12) pick up with their grippers 63 and then transfer, along the second transverse axis Y2, the first group of N1 cartomizers 11 to carry them from the fixed vertical seats 39 of the support plane 25 to the seats 110 of the sliders 109.

The steps of transfer, injection, and removal as described here then repeat in continuity as long as there are cartomizers 11 to fill with the desired liquid.

It will be clear that modifications and/or additional parts and/or steps can be added to the apparatus 10 and the related method described here, without however going beyond the scope of protection of the present invention.

For example, in one variant the first transporting member 101, with the elements that constitute it, i.e. the first chain 102, with the links 103, the sliders 104 with their relative seats 110, as well as the two first toothed wheels 104 and 105, the two electric motors 106 and 107, and the central control unit 108 can be part of the same apparatus 10, so that the latter can operate autonomously.

It will also be clear that even though the present invention is described with reference to a specific example of an embodiment, a person skilled in the art could certainly realize at many other equivalent forms of the machine and/or method for the automatic insertion of a liquid inside components of inhalers, in particular cartomizers for electronic cigarettes, having the characteristics as defined in the enclosed claims and therefore falling within the scope of protection as defined by these claims.

The invention claimed is:

1. An apparatus (10) to automatically insert a liquid inside components (11) of inhalers, wherein each of said components (11) comprises a body (12) defining an internal cavity (13) that extends along a longitudinal axis (C), closed at one of its ends and configured to receive said liquid, said apparatus (10) comprising a means for injecting (50) having at least one injector (52), wherein said at least one injector (52) comprises an injector head (57) placed at one of its ends and having a substantially symmetrical conformation with respect to its symmetrical axis (Z) and configured to cooperate with said internal cavity (13) of said body (12), and at least one injection needle (58) configured to come out with respect to said injection head (57) in order to inject said liquid into the internal cavity (13), while said injection head (57) is stationary with respect to said body (12), arranging itself with the axis of symmetry (Z) substantially coinciding with the longitudinal axis (C) of said internal cavity (13).

2. The apparatus (10) as in claim 1, wherein said at least one injection needle (58) is furthermore configured to inject said liquid into the internal cavity (13) as it is moving to return inside said injection head (57) held stationary with respect to said body (12).

3. The apparatus (10) as in claim 1, wherein said injection head (57) is furthermore configured to insert itself in said internal cavity (13).

4. The apparatus of claim 1, wherein said components comprise cartomizers for electronic cigarettes.

5. The apparatus of claim 1, wherein the body is of a tubular shape.

6. The apparatus (10) as in claim 1, wherein a first transporting member (101), associated with said apparatus (10), or being part of it, is configured to selectively transport, with incremental advances having a pitch (P), a first number (N1) of said components (11) at a time, toward a removal position associated with said means for injecting (50), and further comprising a second transporting member (31) configured to selectively transport, with incremental advances having said pitch (P), a second number (N2) of said components (11) at a time, toward said means for injecting (50), and wherein said second number (N2) is a whole multiple (MI) of said first number (N1).

7. The apparatus (10) as in claim 6, wherein said first number (N1) is fifteen and said whole multiple (MI) is three.

8. The apparatus (10) as in claim 6, further comprising first gripping and means for positioning (40, 41, 42, 43) arranged upstream of said means for injecting (50) and configured to selectively move a number of said components (11) at a time, equal to said first number (N1), from said first transporting member (101) to said second transporting member (31).

9. The apparatus (10) as in claim 8, further comprising second gripping and means for positioning (60, 61, 62, 63) arranged downstream of said means for injecting (50) and configured to selectively move a number of said components (11) at a time, equal to said first number (N1), from said second transporting member (31) to said first transporting member (101).

10. The apparatus (10) as in claim 6, wherein said components (11) are aligned on said first transporting member (101) along a longitudinal axis (X), spaced from one other with a determinate interaxis (IC), and wherein said pitch (P) is equal to said interaxis (IC) for said first number (N1), wherein said second transporting member (31) is parallel to said first transporting member (101) and comprises a chain (32) consisting of a plurality of links (33) articulated with respect to each other and each having an interaxis (IM2) which is a whole submultiple (SM) of said pitch (P).

11. The apparatus (10) as in claim 10, wherein in each of said links (33) there is a plurality of seats (37) each configured to accommodate one of said components (11), and wherein said seats (37) are distributed on a number of parallel rows with respect to each other that is equal to said whole multiple (MI).

12. The apparatus (10) as in claim 11, wherein in each of said links (33), the number of said seats (37) for each of said rows is equal to said whole multiple (MI).

13. The apparatus (10) as in claim 11, wherein said means for injecting (50) comprises a number of injectors (52) equal to said second number (N2) and wherein said injectors (52) are arranged according to a regular matrix consisting of a number of parallel rows corresponding to that of said seats (37) for a number of injectors (52) per row which is equal to said first number (N1).

14. A method to automatically insert a liquid inside components (11) of inhalers, wherein each of said components (11) comprises a body (12) defining an internal cavity (13) that extends along a longitudinal axis (C), closed at one of its ends and configured to receive said liquid, said method comprising:

activating a means for injecting (50) having at least one injector (52) during an injection step, wherein said injection step comprises a first injection sub-step in which an injection head (57) having a substantially symmetrical conformation with respect to its symmetrical axis Z and is arranged at an end of each of said injectors (52) is made to cooperate with said internal cavity (13) of said body (12) together with at least one injection needle (58), and a second injection sub-step wherein said at least one injection needle (58) performs an outward travel during which it is made to exit from said injection head (57) to inject said liquid into the internal cavity (13) while said injection head (57) remains stationary with respect to said body (12) with the symmetrical axis arranged substantially coincidental with the longitudinal axis (C) of said internal cavity (13).

15. The method as in claim 14, wherein said injection step further comprises a third injection sub-step in which said at least one injection needle (58) performs a return travel during which it moves to return into said injection head (57) held stationary with respect to said body (12), it being provided in said third injection sub-step to inject the liquid via said at least one injection needle (58) during at least a part of said return travel.

16. The method as in claims 14, wherein said injection head 57 is partially inserted into said internal cavity (13) in said first sub-step.

17. The method of claim 14, wherein said components comprise cartomizers for electronic cigarettes.

18. The method of claim 14, wherein the body is of a tubular shape.

* * * * *